US009411359B2

(12) United States Patent
Min

(10) Patent No.: US 9,411,359 B2
(45) Date of Patent: Aug. 9, 2016

(54) ACCELERATOR PEDAL APPARATUS FOR VEHICLE

(71) Applicants: Hyundai Motor Company, Seoul (KR); Kia Motors Corp., Seoul (KR)

(72) Inventor: Jeong Seon Min, Gwangju (KR)

(73) Assignees: Hyundai Motor Company, Seoul (KR); Kia Motors Corp., Seoul (KR)

( * ) Notice: Subject to any disclaimer, the term of this patent is extended or adjusted under 35 U.S.C. 154(b) by 303 days.

(21) Appl. No.: 14/097,166

(22) Filed: Dec. 4, 2013

(65) Prior Publication Data

US 2015/0027265 A1 Jan. 29, 2015

(30) Foreign Application Priority Data

Jul. 23, 2013 (KR) ..... 10-2013-0086543

(51) Int. Cl.
*G05G 1/44* (2008.04)

(52) U.S. Cl.
CPC ..... *G05G 1/44* (2013.01); *Y10T 74/20534* (2015.01)

(58) Field of Classification Search
CPC ..... Y10T 74/20534; G05G 1/44; G05G 1/30; G05G 1/045; B60K 26/02
USPC ..... 74/512, 513, 478; 123/399; 116/57
See application file for complete search history.

(56) References Cited

U.S. PATENT DOCUMENTS 3,926,275 A * 12/1975 Nersesian ..... B60K 26/201 116/57
5,415,144 A * 5/1995 Hardin ..... F02D 11/106 123/399
6,260,434 B1 * 7/2001 Holtorf ..... G05G 1/30 74/478
8,635,930 B2 * 1/2014 Willemsen ..... G05G 5/03 74/512
2009/0151502 A1 * 6/2009 Kim ..... B60K 26/02 74/513
2009/0293666 A1 * 12/2009 Kim ..... B60K 26/02 74/513
2010/0319480 A1 * 12/2010 Nebuya ..... G05G 1/36 74/513
2012/0132028 A1 * 5/2012 Kim ..... G05G 1/405 74/512
2013/0305874 A1 * 11/2013 Fuller ..... G05G 1/44 74/513
2014/0338492 A1 * 11/2014 Yokoi ..... G05G 1/30 74/513
2015/0059515 A1 * 3/2015 Min ..... G05G 1/44 74/512

FOREIGN PATENT DOCUMENTS

JP 8-34261 A 2/1996
JP 2003-25863 A 1/2003
JP 2003-312304 A 11/2003
JP 2012-234375 A 11/2012
JP 2012-234376 * 11/2012 ..... G05G 1/44
KR 10-2009-0064192 A 6/2009
KR 100911560 B1 8/2009

OTHER PUBLICATIONS

EPO Machine Translation of JP 2012-234376, Mazda Motor Corp., Nov. 2012.*
Circular/Define Circular at Dictionary.com. Nov. 29, 2015.*

* cited by examiner

*Primary Examiner* — Vinh Luong
(74) *Attorney, Agent, or Firm* — Morgan, Lewis & Bockius LLP

(57) ABSTRACT

An apparatus may include a pedal pad located on a front lower side of a driver seat so as to be depressed by a driver, a first hinge pivotally coupling the pedal pad to a pedal bracket fixedly mounted to the front lower side of the driver seat, and a second hinge having an elastically-operated articulated structure and mounted to the pedal bracket in such a manner as to be connected to the pedal pad, the second hinge being spaced apart from the first hinge.

4 Claims, 7 Drawing Sheets

ACCELERATOR PEDAL APPARATUS FOR VEHICLE

CROSS REFERENCE TO RELATED APPLICATION

The present application claims priority to Korean Patent Application No. 10-2013-0086543 filed Jul. 23, 2013, the entire contents of which is incorporated herein for all purposes by this reference.

BACKGROUND OF THE INVENTION

1. Field of the Invention

The present invention relates, in general, to an accelerator pedal apparatus for a vehicle in which, even when a hinge of a pedal pad is broken, the pedal can be operatively manipulated, thereby ensuring safe driving.

2. Description of Related Art

Generally, an accelerator pedal apparatus in a vehicle is divided, according to a mounting structure, into a pendant type accelerator pedal which is mounted suspended from a dashboard and an organ type accelerator pedal which is mounted to a floor panel.

In the case of an organ type accelerator pedal, a motion of a pad is the same as a motion of a driver's ankle, so that a driver can advantageously manipulate the organ type accelerator pedal more conveniently than a pendant type accelerator pedal.

As shown in FIGS. 1 and 2, an exemplary organ type accelerator pedal apparatus includes a pedal housing 1 which is fixedly mounted to a panel of a vehicle body (a floor panel) located below a driver seat; a pad 3, one end of which is connected to a pad-coupling part 1*a* of the pedal housing 1 via a hinge 2, so as to pivot via manipulation by a driver's foot; a pedal arm 5 which is disposed and mounted in an internal space 1*b* of the pedal housing 1 such that the pedal arm can pivot on a pivot axis 4 relative to the pedal housing 1; a carrier 6 which connects the pad 3 and one end of the pedal arm 5; and an elastic member 7 which is mounted to be supported, at both ends thereof, to the other end of the pedal arm 5 and an inner surface of the pedal housing 1, so as to provide an elastic restoring force to the pivot motion of the pedal arm 5.

However, in such an organ type accelerator pedal apparatus, since the hinge of the pad protrudes to the outside and a pad coupling which couples the pad is provided with a single hinge, if the hinge is broken, the pad cannot be supported by the hinge, adversely affecting the driving and thus possibly causing an accident. Thus, there is a need for a pedal structure which does not affect driving even upon breakage in the hinge of the pedal pad.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing an accelerator pedal apparatus for a vehicle which, even when a hinge of a pedal pad is broken, allows the pedal pad to normally operate, thereby ensuring driving safety while providing reliability for manipulation of the pedal pad.

In an aspect of the present invention, an accelerator pedal apparatus for a vehicle, may include a pedal pad configured to be depressed by a driver, a pedal bracket, a first hinge pivotally coupling the pedal pad to the pedal bracket, and a second hinge having an elastically-operated articulated structure, wherein the second hinge is mounted to the pedal bracket and connected to the pedal pad, the second hinge being spaced apart from the first hinge.

The pedal pad may include an upper pad part and a lower pad part, and the second and first hinges are connected to the upper pad part and the lower pad part, respectively.

The lower pad part is provided, on an upper portion thereof, with a mounting groove, and a lower portion of the upper pad part is slidably inserted into the mounting groove.

The upper pad part is tapered such that a width of the lower portion decreases downwards.

A length of the upper pad part to be inserted into the mounting groove is longer than a maximum displacement of the upper pad part sliding over along and moved in the mounting groove when the pedal pad is fully manipulated.

The first hinge is a film member that is connected to a lowermost end of the pedal pad as a center of rotation.

The second hinge extends in a circular shape curved upwards from the pedal bracket and is connected to the pedal pad.

According to the present invention, the pedal pad is provided with plural hinges, so that, even when one of the hinges is broken, the hinge function can be still maintained, thereby allowing the pedal pad to normally operate. Also, the accelerator pedal apparatus employs an articulated hinge structure, thereby providing uniform depression to the pedal pad.

Accordingly, the present invention can ensure driving safety while providing reliable, uniform manipulability of the pedal pad.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
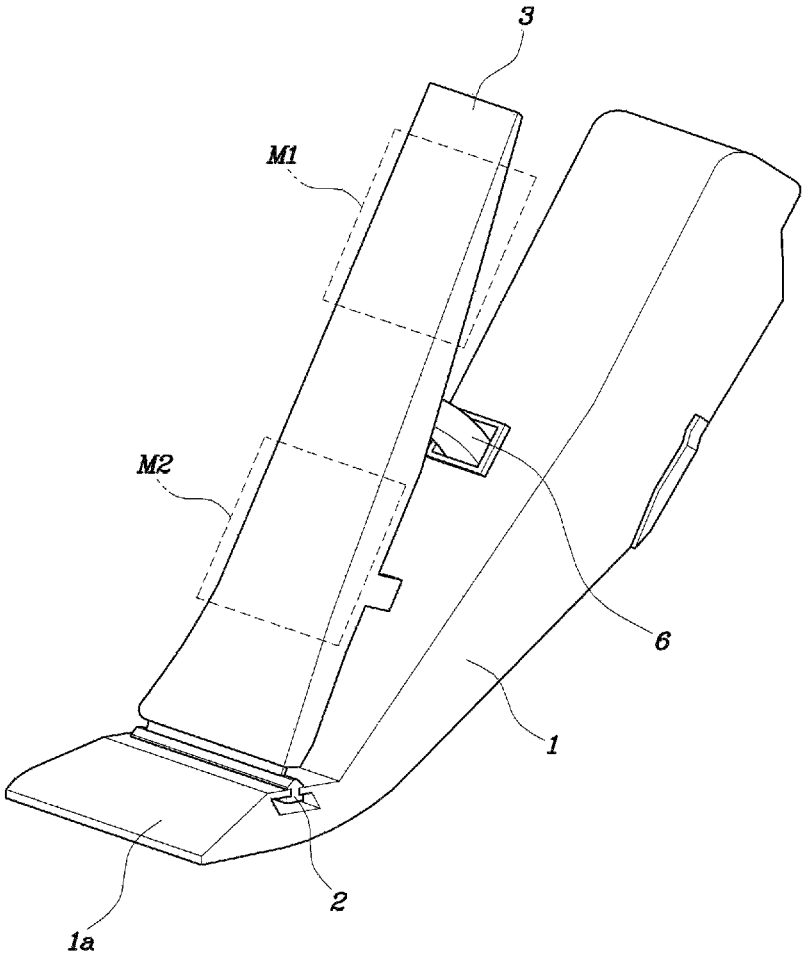
FIG. 1 (Related Art)
FIGS. 1 and 2 are views showing an organ type accelerator pedal apparatus according to the related art.
Figure 2:
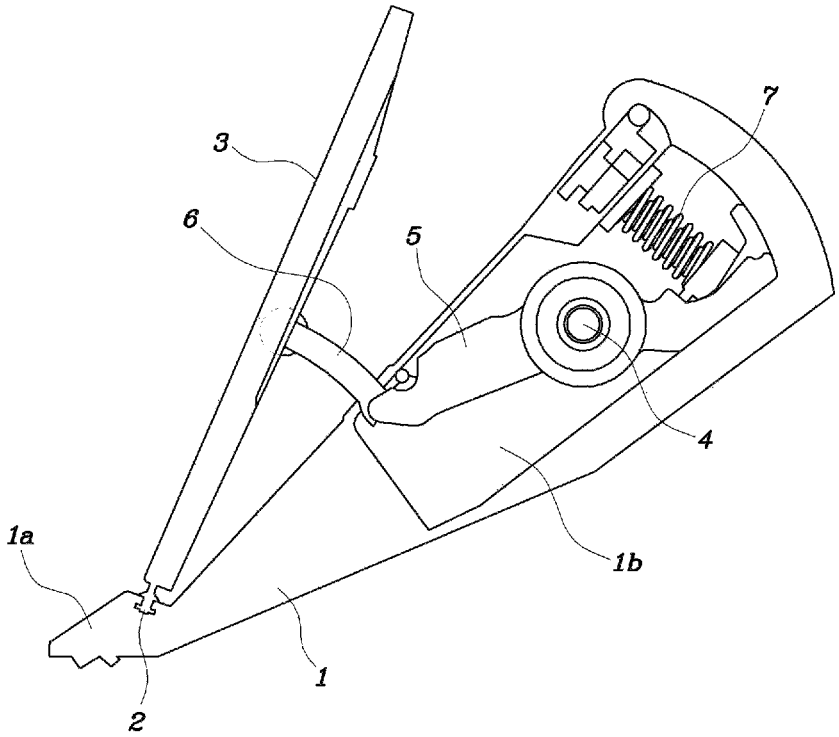
FIG. 2 (Related Art)

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Hereinbelow, a description is made in detail of a preferred embodiment of an accelerator pedal apparatus for a vehicle with reference to the accompanying drawings.

Figure 3:
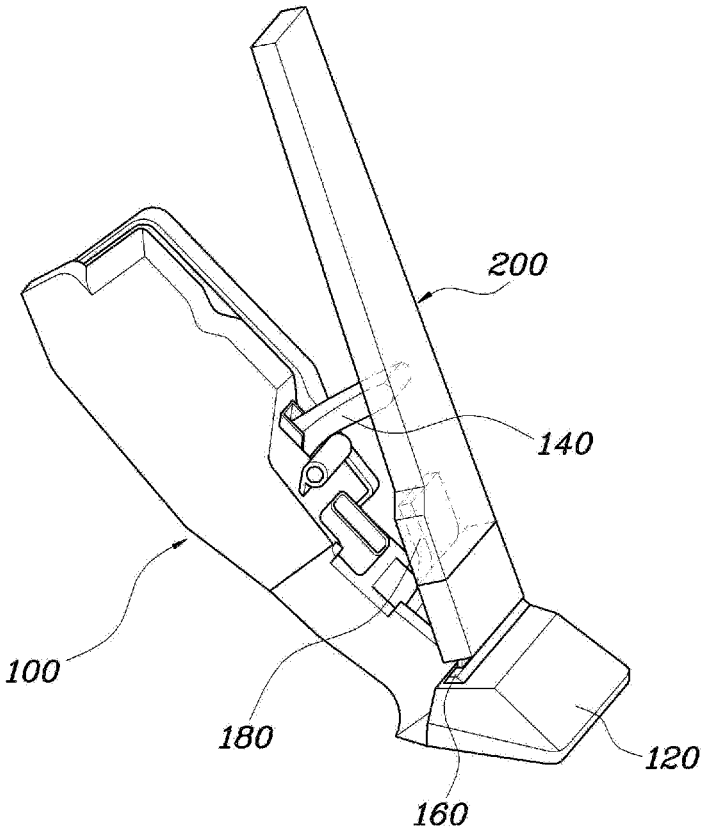
FIG. 3 is a perspective view of an accelerator pedal apparatus for a vehicle according to an exemplary embodiment of the present invention.
Figure 4:
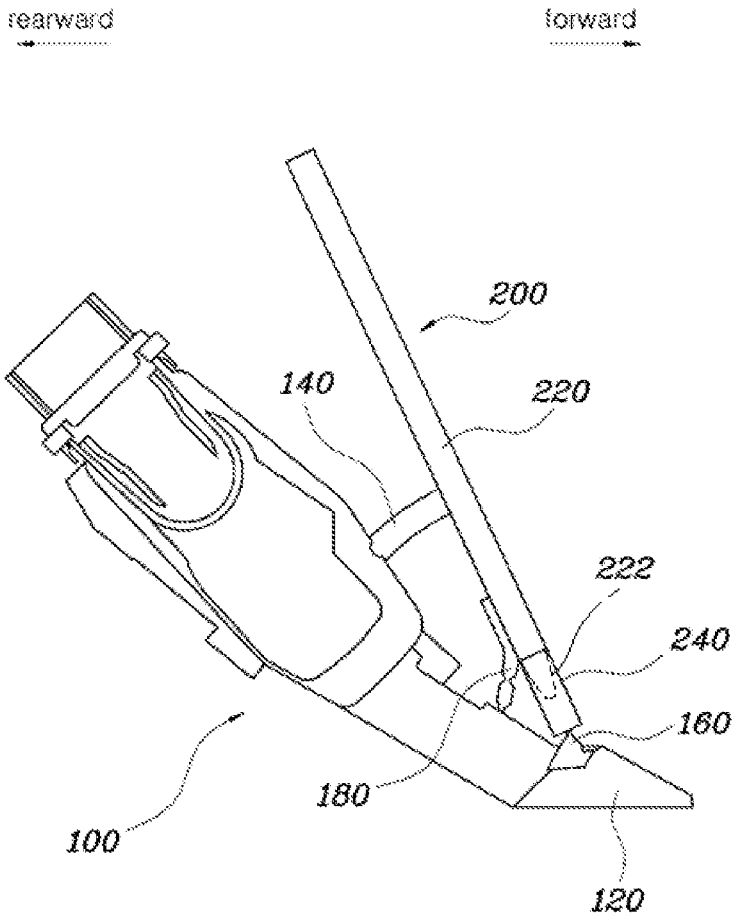
FIG. 4 is a side view of the accelerator pedal apparatus for a vehicle shown in FIG. 3.
Figure 5:
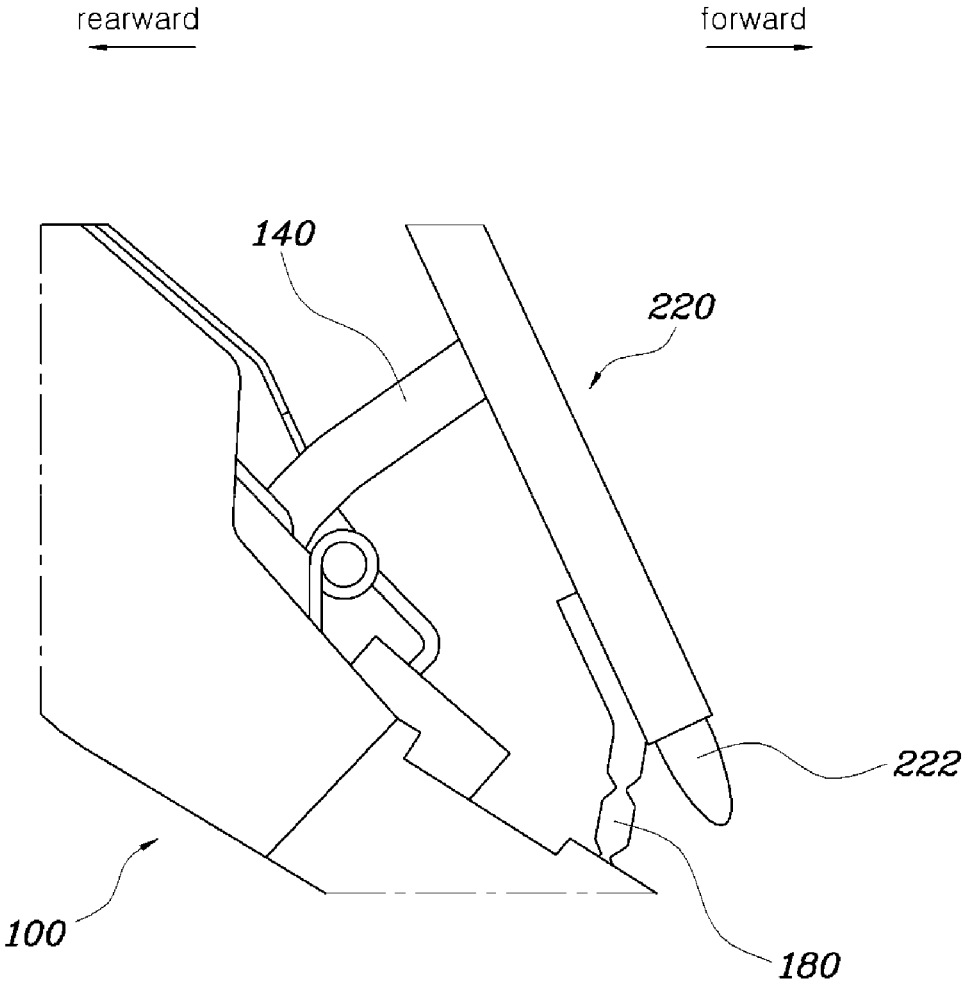
FIG. 5 is a view showing an upper pad part and a first hinge of the accelerator pedal apparatus of FIG. 3.
Figure 6:
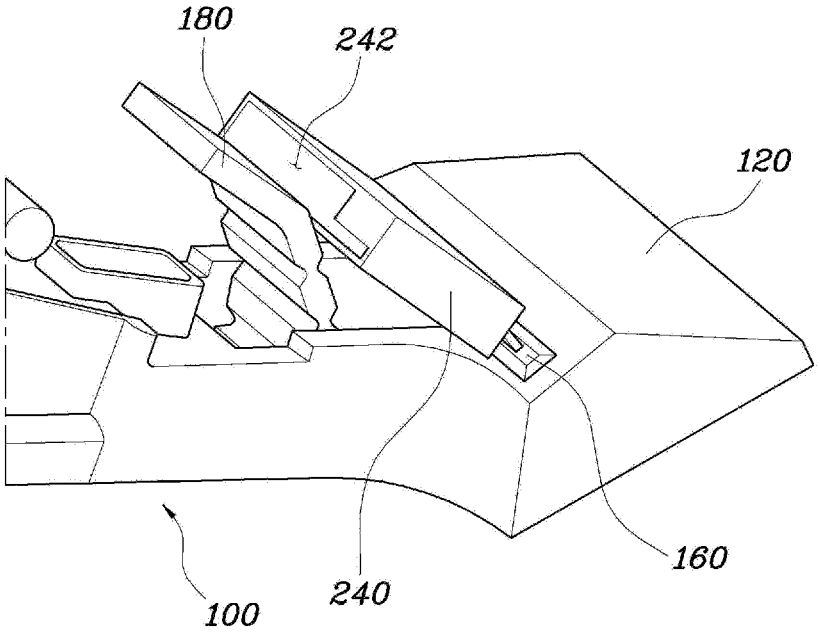
FIG. 6 is a view showing the first hinge and a second hinge of the accelerator pedal apparatus of FIG. 3.

FIG. 3 is a perspective view of an accelerator pedal apparatus for a vehicle according to an exemplary embodiment of the present invention, FIG. 4 is a side view of the accelerator pedal apparatus for a vehicle shown in FIG. 3, FIG. 5 is a view showing an upper pad part and a first hinge of the accelerator pedal apparatus of FIG. 3, and FIG. 6 is a view showing the first hinge and a second hinge of the accelerator pedal apparatus of FIG. 3.

The accelerator pedal apparatus for a vehicle according to an exemplary embodiment of the present invention is of an organ type, which includes a pedal bracket 100 which is fixedly mounted to a panel of a vehicle body which is disposed below a driver seat, a pedal pad 200, one end of which is connected to a pad coupling 120 of the pedal bracket 100 via a hinge so that the pedal pad is able to be manipulated by a driver, a pedal arm which is elastically pivotally mounted in the pedal bracket 100, and a carrier 140 which is connected to the pedal arm and the pedal pad 200.

Specifically, as shown in FIGS. 3 to 6, the accelerator pedal apparatus includes: a pedal pad 200 which is located on a front lower side of a driver seat so as to be depressed by a driver, a first hinge 160 which pivotally couples the pedal pad 200 to a pedal bracket 100 which is fixedly mounted on the front lower side of the driver seat, and a second hinge 180 which has an elastically articulated structure and which is mounted spaced apart from the first hinge 160 to the pedal bracket 100 in such a manner as to be connected to the pedal pad 200.

According to an exemplary embodiment of the present invention, the plurality of the hinges is connected to the pedal pad, so that, even when one of the hinges is broken, the pedal pad 200 can be stably pivoted.

The hinge includes first and second hinges 160 and 180, which are mounted to the pedal bracket 100 such that the first and second hinges are connected to the pedal pad 200. The first hinge 160 is formed from a film member that is connected to a lowermost end of the pedal pad 200 as the center of rotation for the pedal pad 200. The first hinge 160 may have a hinge structure commonly used in an organ type pedal. The first hinge 160 including the film member can save on manufacturing cost and contributes to a simplified structure.

The pedal pad 200 is pivotally mounted to the pedal bracket 100 via the first hinge 160. Further, the second hinge 180 is also mounted to the pedal bracket 100 to support the pedal pad 200.

Here, the second hinge 180 is mounted to the pedal bracket 100 in such a manner as to be spaced a distance apart from the first hinge 160, preferably rearwards from the first hinge 160 as shown in FIG. 4. The second hinge 180 displaced rearwards from the first hinge 160 is not exposed to the outside, thereby being prevented from being broken by environmental factors.

The second hinge 180 has an elastically-operated articulated structure. The elastically-operated articulated structure of the second hinge 180 minimizes the reaction of the pedal pad 200 occurring when a driver manipulates the pedal pad 200, thereby mitigating a driver's fatigue.

The second hinge 180 extends from the pedal bracket 100 in a circular shape curved upwards and is connected to the pedal pad 200.

The curved shape of the second hinge 180 can mitigate the reaction of the pedal pad 200 when a driver manipulates the pedal pad 200. Here, as shown in FIGS. 4 and 5, the second hinge 180 is preferably curved from the forward side to the rearward side so as to enhance elastic deformation of the second hinge 180 which is obtained by the articulated structure.

While the plurality of hinges mounted to the pedal pad 200 may require a further force when a driver manipulates the pedal pad 200, such an articulated structure of the second hinge 180 can reduce a driver's effort to manipulate the pedal pad. Further, the articulated structure of the second hinge 180 may be modified such that the number and thickness of joints thereof varies so as to properly set an elastic force of the second hinge, thereby providing a uniform force required to manipulate the pedal pad 200.

The pedal pad 200 may include an upper pad part 220 and a lower pad part 240, to which the second and first hinges 180 and 160 may be respectively connected. The upper and lower pad parts 220 and 240 are configured such that the upper pad part 220 slips out along the lower pad part 240 when a driver manipulates the pedal pad.

In the exemplary embodiment of the present invention, the first and second hinges 160 and 180 are coupled to the pedal pad 200, and the second hinge 180 has an articulated structure and is mounted to the rearward side of the first hinge 160. In this state, when the driver manipulates the pedal pad 200, the first hinge 160 serves as the center of rotation for the pedal pad 100, and the second hinge 180 pivots the pedal pad 200 while joints thereof are elastically deformed. Here, as the displacement of the pedal pad 200 increases, the deformation force of the second hinge 180 increases. However, such an increase in the deformation force of the second hinge 180 causes the reaction applied to the pedal pad 200 to increase, so that the reaction of the pedal pad 200 may not be sufficiently reduced.

To avoid this, the upper and lower pad parts 220 and 240 are configured to be able to slip over each other. Specifically, the lower pad part 240 is provided, on an upper portion thereof, with a mounting groove 242 such that the upper pad part 220 is slidably inserted into the mounting groove 242 from a lower portion thereof.

Such an inter-slidable connection between the upper and lower pad parts 220 and 240 is shown in FIGS. 5 to 7. Here, a sectional area of the mounting groove 242 of the lower pad part 240 is formed to be larger than that of the lower portion 222 of the upper pad part 220, thereby allowing the lower portion of the upper pad part 220 to smoothly slip over in the mounting groove during manipulation of the pedal pad 200.

Further, the upper pad part 220 may be tapered such that a width of the lower portion 222 to be inserted into the mounting groove 242 decreases downwards.

The pedal pad 200 includes the upper and lower pad parts 220 and 240 which are inter-slidable. When the upper pad part 220 slips out along the lower pad part 240 during the manipulation of the pedal pad 200, the upper pad part 220 may engage with the mounting groove 242 of the lower pad part 240 so as thus to cause an unsmooth slipping action because the slipping of the upper pad part is conducted along the lower pad part 240 during pivoting operation. Thus, the tapered lower portion of the upper pad part 220 ensures smooth slip action in the mounting groove 242 when a driver manipulates the pedal pad 200.

As described above, the inter-slidable connection between the upper and lower pad parts 220 and 240 during manipulation of the pedal pad 200 mitigates deformation load caused by the second hinge 180, thereby preventing an excessive deformation of the second hinge 180. Further, the slipping movement between the upper and lower pad parts 220 and 240 during manipulation of the pedal pad 200 also provides easy manipulation for a driver.

A length of the lower portion 222 of the upper pad part 220 to be inserted into the mounting groove 242 may be longer than a maximum displacement of the upper pad part 220 slid and moved in the mounting groove 242 when the pedal pad 200 is fully manipulated.

If the lower portion 222 of the upper pad part 220 is not sufficiently inserted into the mounting groove 242 of the lower pad part 240, upon complete manipulation of the pedal pad 200, the upper pad part 220 may be decoupled from the mounting groove 242. Thus, the lower portion 222 of the upper pad part 220 has a sufficient length to be deeply inserted into the mounting groove 242 such that, even when the pedal pad 200 is manipulated to the maximum stroke, the lower portion 222 is not moved out of the mounting groove 242, thereby preventing the upper and lower pad parts 220 and 240 from being separated from each other.

Figure 7A:
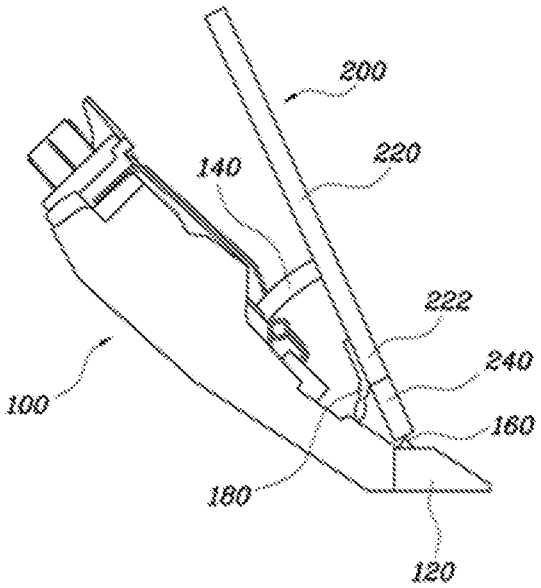
FIGS. 7A and 7B are views showing the operation of the accelerator pedal apparatus of FIG. 3.
Figure 7B:
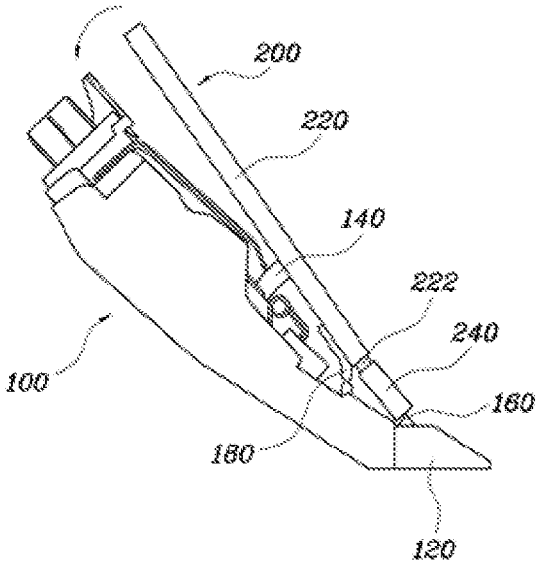

The operation of the exemplary embodiment of the invention will be described with reference to FIGS. 7A and 7B. In an initial state where the pedal pad 200 is not yet manipulated, the lower portion 222 of the upper pad part 220 is fully inserted into the mounting groove 242 of the lower pad part 240, and the pedal pad 200 is supported by the carrier 140, the first hinge 160, and the second hinge 180. In this stage, when a driver manipulates the pedal pad 200, the upper and lower pad parts 220 and 240 are pivoted about the first hinge 160, and as the depression pressure on the pedal pad increases, the second hinge 180 of articulated structure is increasingly folded and deformed, so that the upper pad part 220 slips over along the lower pad part 240.

Such an operation improves the manipulation of the pedal pad 200, and causes the second hinge 180 to be elastically deformed so as to mitigate the effort of a driver to depress the pedal pad.

Further, the hinge structure for pivoting the pedal pad is configured to have the first and second hinges 160 and 180, so that, even when one of the hinges is broken due to environmental factors or structural durability issues, the pedal pad can be normally operated.

Accordingly, such a configuration can ensure driving safety while providing reliable, uniform manipulability for the pedal pad.

Although a exemplary embodiment of the present invention has been described for illustrative purposes, those skilled in the art will appreciate that various modifications, additions and substitutions are possible, without departing from the scope and spirit of the invention as disclosed in the accompanying claims.

For convenience in explanation and accurate definition in the appended claims, the terms "upper", "lower", "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. An accelerator pedal apparatus for a vehicle, comprising:

a pedal pad configured to be depressed by a driver;

a pedal bracket;

a first hinge pivotally coupling the pedal pad to the pedal bracket; and a second hinge having an elastically-operated articulated structure, wherein the second hinge is mounted to the pedal bracket and connected to the pedal pad, the second hinge being spaced apart from the first hinge, wherein the pedal pad includes an upper pad part and a lower pad part, and the second and first hinges are connected to the upper pad part and the lower pad part, respectively, wherein the lower pad part is provided, on an upper portion thereof, with a mounting groove, and a lower portion of the upper pad part is slidably inserted into the mounting groove, and wherein the upper pad part is tapered such that a width of the lower portion decreases downwards.

2. The accelerator pedal apparatus for the vehicle according to claim 1, wherein a length of the upper pad part to be inserted into the mounting groove is longer than a maximum displacement of the upper pad part sliding over along and moved in the mounting groove when the pedal pad is fully manipulated.

3. The accelerator pedal apparatus for the vehicle according to claim 1, wherein the first hinge is a film member that is connected to a lowermost end of the pedal pad as a center of rotation.

4. The accelerator pedal apparatus for the vehicle according to claim 1, wherein the second hinge extends in an arc shape curved upwards from the pedal bracket and is connected to the pedal pad.

* * * * *